United States Patent [19]

Jackson

[11] Patent Number: 4,489,681

[45] Date of Patent: Dec. 25, 1984

[54] MULTIPLE PISTON EXPANSION CHAMBER ENGINE

[76] Inventor: Francis W. Jackson, 409 Penwyn Rd., Wynnewood, Pa. 19096

[21] Appl. No.: 326,902

[22] Filed: Dec. 2, 1981

[51] Int. Cl.[3] ..... F02B 75/18

[52] U.S. Cl. ..... 123/52 B; 123/53 A; 123/78 R

[58] Field of Search ..... 123/52 B, 51 R, 193 P, 123/53, 78 R, 78 A, 78 B, 51 B

[56] References Cited

U.S. PATENT DOCUMENTS

| | | | |
|---|---|---|---|
| 1,309,891 | 7/1919 | Griffith | 123/52 B |
| 1,564,009 | 12/1925 | Myers | 123/78 A |
| 1,734,867 | 11/1929 | Martin | 123/52 B |
| 2,734,494 | 2/1956 | Waterval | 123/52 B |

FOREIGN PATENT DOCUMENTS

| | | | |
|---|---|---|---|
| 0901605 | 1/1954 | Fed. Rep. of Germany | 123/52 B |
| 0399538 | 6/1909 | France | 123/52 B |

*Primary Examiner*—Craig R. Feinberg

[57] ABSTRACT

A multiple piston expansion chamber internal combustion engine wherein the charge is ignited and combusted (or partially combusted) and partially expanded by one or more of the pistons and after partial expansion thereof additional pistons augment the expansion process.

1 Claim, 9 Drawing Figures

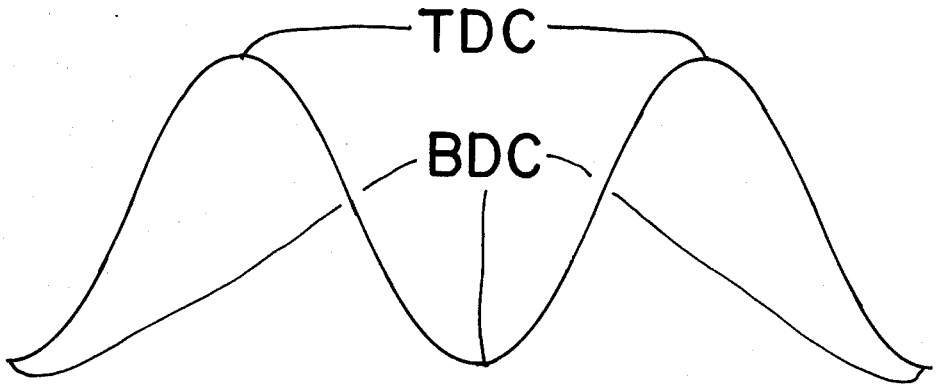
FIG. 2A Center Piston
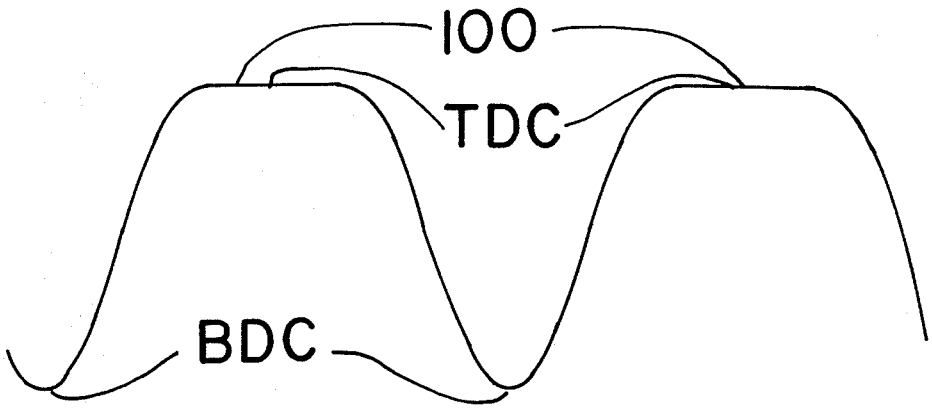
FIG. 2B Annular Piston
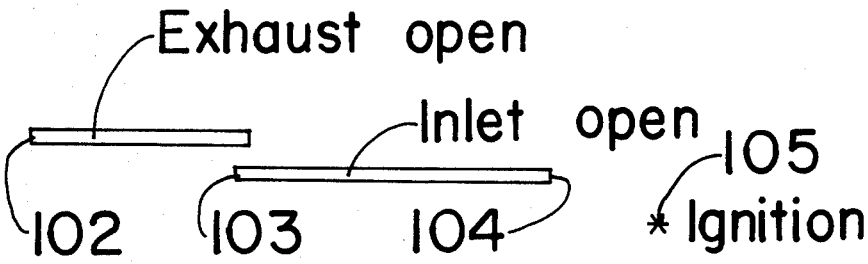
FIG. 2C Valve and Ignition

MULTIPLE PISTON EXPANSION CHAMBER ENGINE

DESCRIPTION OF PRIOR ART

In prior art the balance of many factors has led to cylinder designs with stroke to bore's around 1. Given this stroke to bore and an average piston speed the engine efficiency and weight for a given cylinder horsepower is pretty well set.

SUMMARY

The use of multiple expansion chambers configured to partially expand the combusted charge in the combustion chamber and then to complete the expansion process using a supplemental expansion chamber with chamber isolation designs that when allowing communication between these chambers accomplish the communication with minimal throttling and minimum added wetted perimiter provides attractive improvements.

The smaller diameter initial chamber allows flame speed to not be as restrictive on stroke to bore. This permits, for flame speed considerations, smaller stroke to bore's to be used. Lower stroke to bore's are not accompanied by significantly increased friction losses as only the combustion chamber sees peak chamber pressure while the auxiliary chamber(s) with significantly reduced peak pressure requires smaller bearings. Engine heat transfer losses are down. The net result is increased engine efficiency at reduced weight.

BRIEF DESCRIPTION OF DRAWINGS

FIGS. 2A, B and C show the relationship in time for the 4 strokes of the working piston displacement, the auxiliary piston displacement, exhaust valve open, inlet valve open and ignition.

FIG. 1 shows the invention in a 4 stroke spark ignition engine application. Center reciprocating piston 10 with piston rings 11 and oil ring 12 sealing between said piston 10 and cylindrical wall 13 in which piston 10 moves as it is driven by rotating crank 14 thru rod 15 and wrist pin 16. Rod 15 connected to wrist pin 16 thru bearing 17 and to crank 14 thru bearing 18. Rotating crank 14 is held by main bearings 38.

Figure 1:
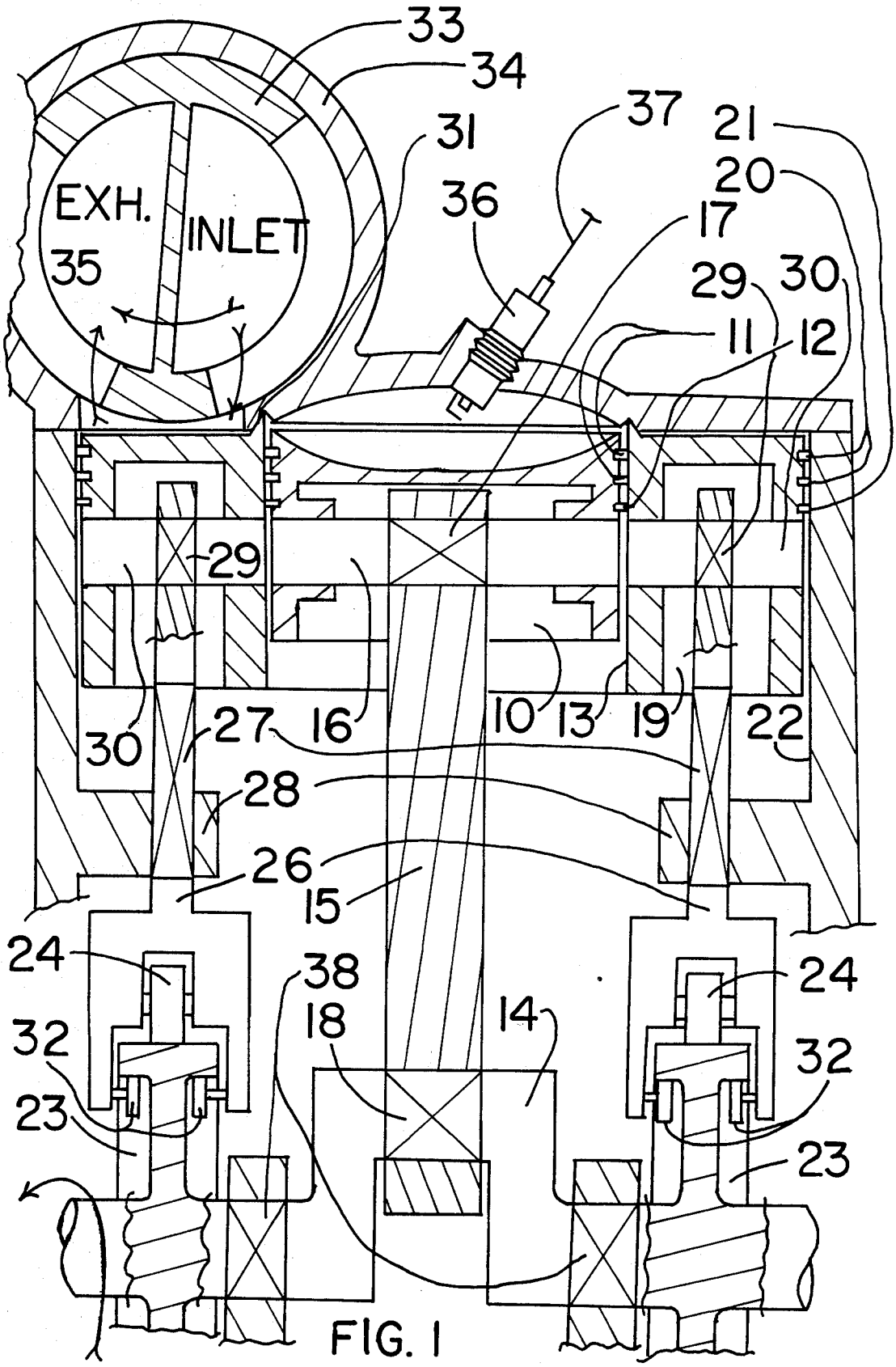
FIG. 1 is a sectional view of one form of the engine.

Annular piston 19, with piston rings 20 and oil ring 21 sealing the outer circumference of annular piston 19 and the outer cylindrical wall 22 in which annular piston 19 moves as identical displacement cams 23 rotating as crank 14 rotates and with push cam follows bearings 24 and pull cam follows bearings 32 pushing or pulling cam follows rods 26. Said cam follower rods constrained in direction by bearing 27 sliding in bearing housing 28. As the two cam follower rods act in unison and, thru wrist pin bearings 29 and wrist pins 30, reciprocate annular piston 19 and at TDC annular mating surface 31 of annular piston 19 seals against the mating surface in the engine head 34. Rotating valve 33 rotating in head 34 commutating carbureated inlet mixture during ingestion to the chamber 35 above the annular piston 19 closing the port to chamber 38 during the compression and expansion strokes and exposing the chamber 35 to the exhaust manifold during exhaust. Spark plug 36 connected to the distributor thru lead 37 ignites the combustible mixture.

FIGS. 2A, B and C present the displacements of the circular and annular pistons, the exhaust and inlet openings and ignition timing for the configuration defined in FIG. 1, during the 2 revolutions of a 4 stroke SI engine cycle. FIG. 2A depicts the displacement of the center round piston as it moves between TDC and BDC. FIG. 2B depicts the annular piston motion with a dwell at TDC 100. FIG. 2C shows that the exhaust port uncovers as the annular piston approaches BDC 102, inlet port opens 103 just prior to the minimum volume condition of the combined chambers above both pistons, with the exhaust closing immediately after. This condition continuing until the annular piston is past BDC 104. Ignition 105 occurs just prior to the sealing of the annular piston and the head.

Said annular piston and head seal remaining sealed 100 until partial expansion of the charge by the center piston, then at 90° of crank rotation after TDC of the center piston the cam moves the annular piston away from the head breaking the seal and permitting combustion products to flow into the chamber above the annular piston and both pistons now provide expansion.

Figure 3:
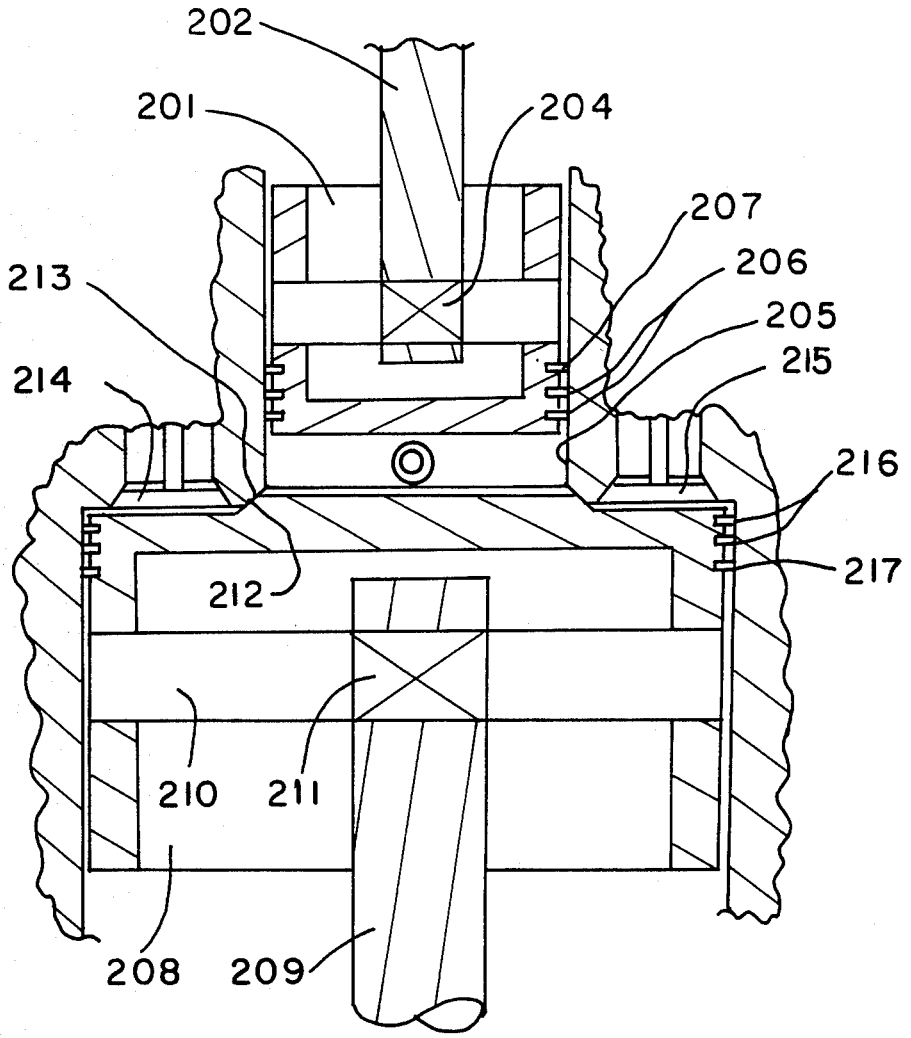
FIG. 3 is a sectional view of another form of the engine.

FIG. 3 shows the invention using 2 cylindrical pistons in an opposed configuration. Reciprocating piston 201 driven by rod 202 from conventional crank (not shown). Said piston 201 being connected to rod 202 thru wrist pin 203 via bearing 204. Piston 201 is reciprocating (see FIG. 2A) in cylinder wall 205 and sealed by pressure rings 206 and oil seal rings 207. Piston 208 is cam driven (to FIG. 1 annular piston profile) thru cam followers 209 connected to piston 208 via wrist pin 210 and bearing 211. Piston 208 motion is as shown in FIG. 2B. Piston 201 motion is as shown in FIG. 2A.

Figure 4:
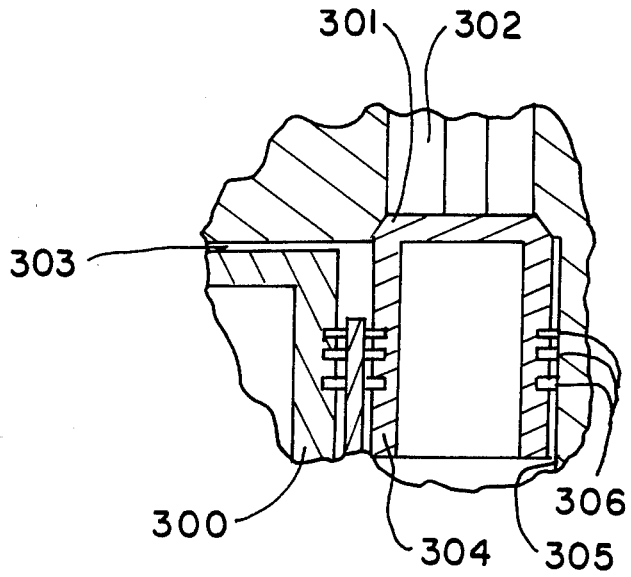
FIG. 4 is a sectional view employing an alternative valve arrangement.

FIG. 4 shows an alternate valve arrangement detail where the valves are located outside the outer diameter of the annular piston 300. Inlet valve 301 sealing inlet manifold 302 to the chamber above the annular piston 303. The valve 301 has cylindrical barrel 304 sliding in cylindrical wall 305 sealed by rings 306 thereby minimizing the chamber volume when the annular piston is at TDC. A valve for exhaust is also similarly configured at a different location around the chamber. Additionally to provide adequate valve area multiple inlet and/or exhaust valves can be employed.

Figure 5:
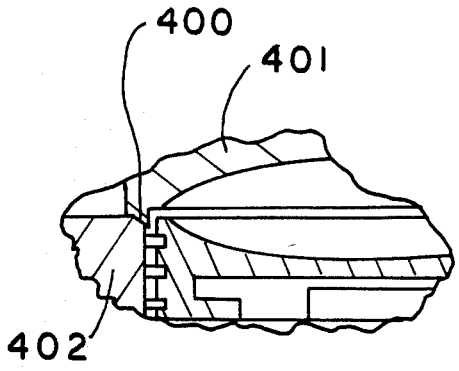
FIG. 5 is the same form of engine as FIG. 1 but with a modified seal.

FIG. 5 shows a variation to FIG. 1 when the tapered raised edge of the seal 400 is attached to the head 401 instead of the annular piston 402 enabling improved cooling of this protrusion.

Figure 6:
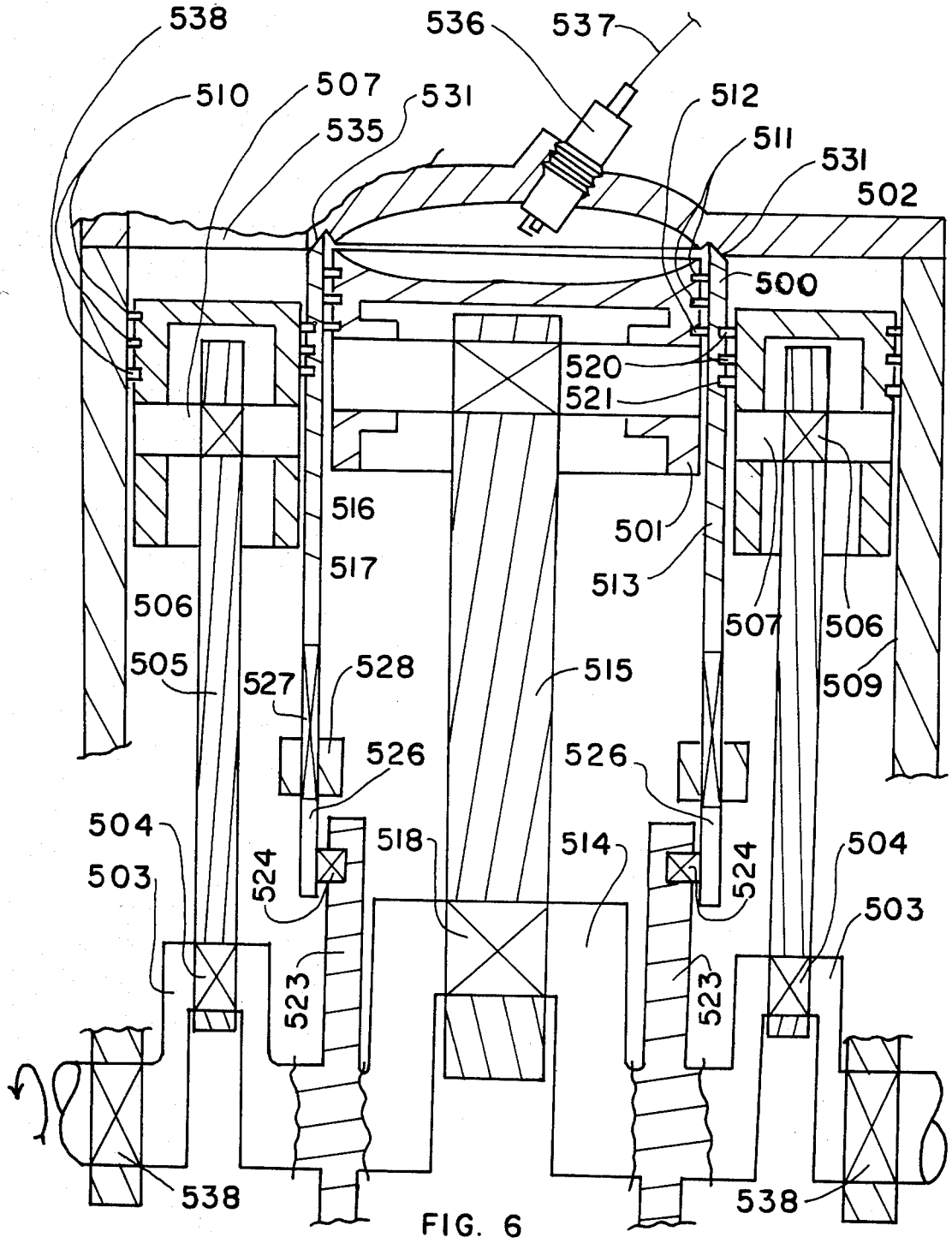
FIG. 6 is another form of the engine wherein both pistons are crank driven.

FIG. 6 shows an adaptation where the cam driven element is a thin annular 500 acting primarily as a valve between the center cylindrical piston 501 and the outer annular piston 502.

Center reciprocating piston 501 with piston rings 511 and oil ring 512 sealing between said piston 501 and cylindrical wall 513 in which piston 501 moves as it is driven by rotating crank 514 thru rod 515 and wrist pin 516. Rod 515 connected to wrist pin 516 thru bearing 517 and to crank 514 thru bearing 518. Rotating crank 514 is held by main bearings 538.

Annular valve 500 with piston rings 520 and oil ring 21 sealing the outer circumference of annular valve 519 and the annular piston 502 in which annular valve 500 moves as identical displacement cams 523 rotating as crank 514 rotates and with push and pull cam follow bearings 524 pushing or pulling cam follows rod 526. Said cam follower rods constrained in direction by bearing 527 sliding in bearing housing 528. The two cam follower rods act in unison reciprocating annular valve 500 and at TDC circular mating surface 531 of annular valve 500 seals against the mating surface. Twin cranks 503 also on the main crank operating in unison thru crank bearings 504 which drive rods 505 thru bearings 506 and wrist pin 507, reciprocate annular piston 502 sealed against the outer cylindrical wall 509 thru rings 510 and oil seal ring 538. Rotary inlet/exhaust valve is as shown in FIG. 1 and located above the annular piston 502 commutating carbureated inlet mixture during ingestion and to the exhaust manifold during exhaust to the chamber above the annular piston 502 and closing the port 535 during the compression (or partial compression) and expansion stroke. Spark plug 536 connects to the distributor thru lead 537 ignites the combustible mixture.

Figure 7A:
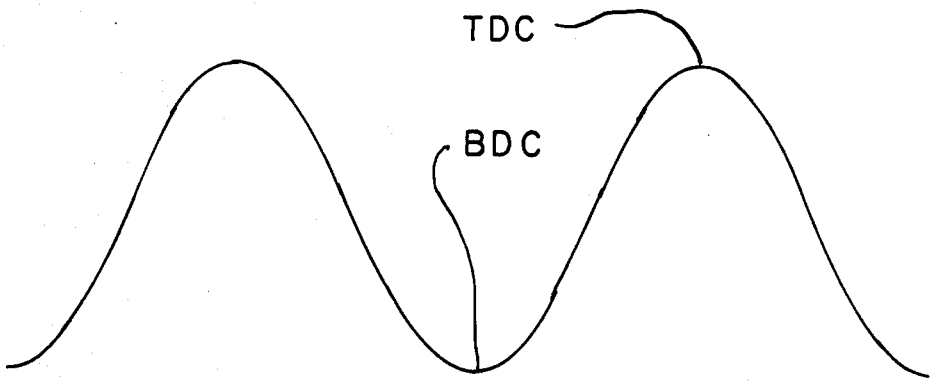
FIGS. 7A, B and C show timing relationships for the FIG. 6 engine.
Figure 7B:
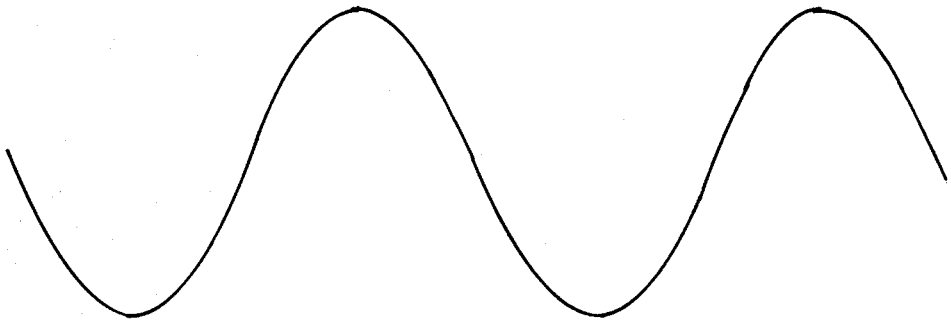

FIGS. 7A, B and C present the displacements of the circular and annular pistons, the exhaust and inlet openings and ignition timing for the configuration defined in FIG. 6 during the 2 revolutions of a 4 stroke SI engine cycle. FIG. 7A depicts the displacement of the center round piston as it moves between TDC and BDC. FIG. 7B depicts the annular motion. Exhaust port uncovers as the annular piston approaches BDC, inlet port opens just prior to the minimum volume condition of the combined chambers above both pistons and the exhaust closes immediately after this condition and continues until the annular piston is past BDC where the inlet closes. Ignition occurs just prior to the sealing of the annular piston and the head.

Said annular valve and head seal remaining sealed until partial expansion of this charge by the center piston. Then at 90° of crank rotation after TDC of the center piston; the cam moves the annular valve away from the head, breaking the seal and permitting combustion products to flow into the chamber above the annular piston and both pistons now provide expansion. Some alternatives are to have separate drive cranks for the center and annular piston and provide 3 or 1 strokes of the annular piston for each two strokes of the center piston and/or to have a separate drive for the annular valve.

Figure 8:
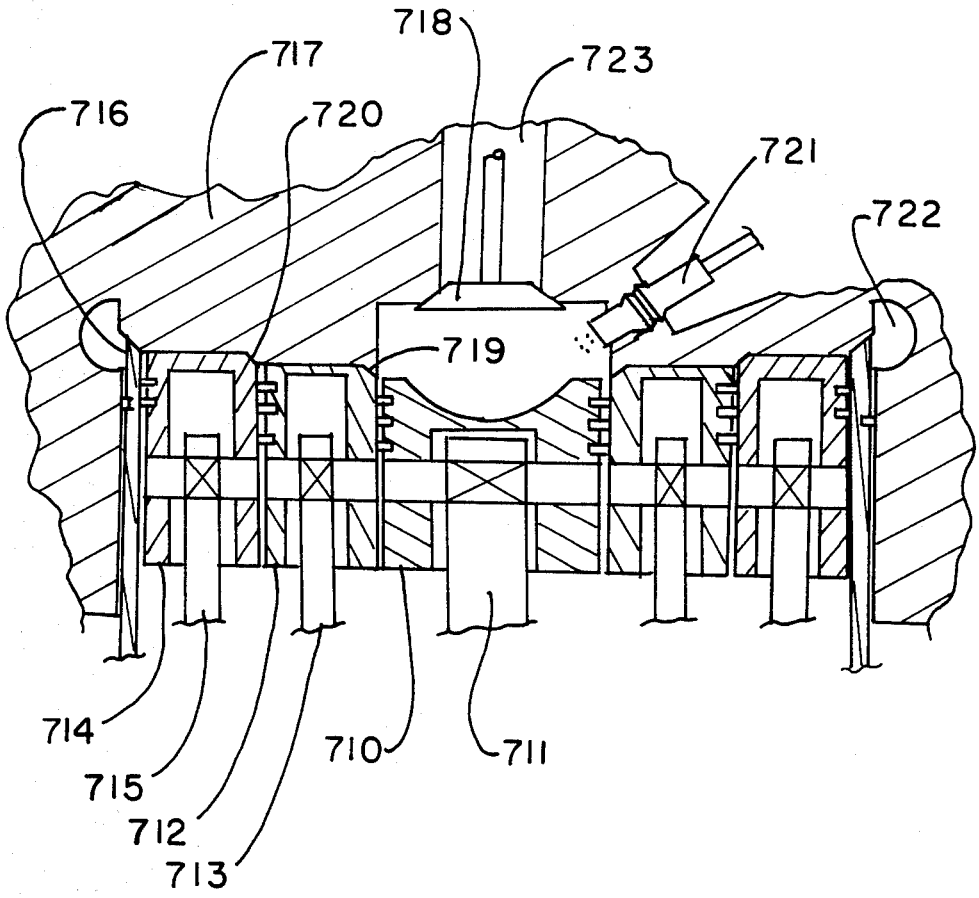
FIG. 8 shows a plurality of auxiliary pistons configuration.

FIG. 8 shows the invention with a 4 stroke fuel injection engine. Center piston 710 driven by crank 711 used in a conventional rotating crank engine design while inner annular piston 712 driven by cam motion follower 713, outer annular piston 714 driven by cam motion follower 718 and annular exhaust valve 716 driven by cam motion follower (not shown). The operation is as follows as exhaust valve 716 is closing and with annular pistons 710 and 712 dwelling while leaving clearance between their upper surfaces and the head 717 and center piston 710 approaching TDC, inlet valve 718 starts to open. Then piston 710 reaches TDC and all pistons withdraw from the engine head 717 and air is injested. After BDC of the pistons the inlet valve 718 closes and before TDC of center piston 710 annular pistons 712 and 714 bottom on head 717 and seal on their respective sealing surfaces 719 and 720 and fuel injector 721 injects fuel into the compressed air where combustion takes place. Center piston 710 passes thru TDC and when it has partially expanded the combusted products inner annular piston 712 moves away from the head and then annular piston 714 as all the pistons jointly expand the charge. Next as fullest expansion is approached the exhaust valve 716 opens and after fullest expansion the three pistons force the exhaust gas into exhaust passage 722.

Some of the many optional approaches are as follows:

1. Use only part of the stroke available for the annular piston during the intake and/or exhaust and/or compression and/or expansion strokes to provide different intake, exhaust, compression and expansion ratios.
2. Do not use one or more of the pistons during intake and/or exhaust and/or compression and/or expansion to accomplish the same objective as 1 above.
3. Use super charging of the inlet supply to provide more charge flow rate thru the inlet valve opening, expecially good for designs where injestion strokes are short or where speeds are high.

Figure 7C:
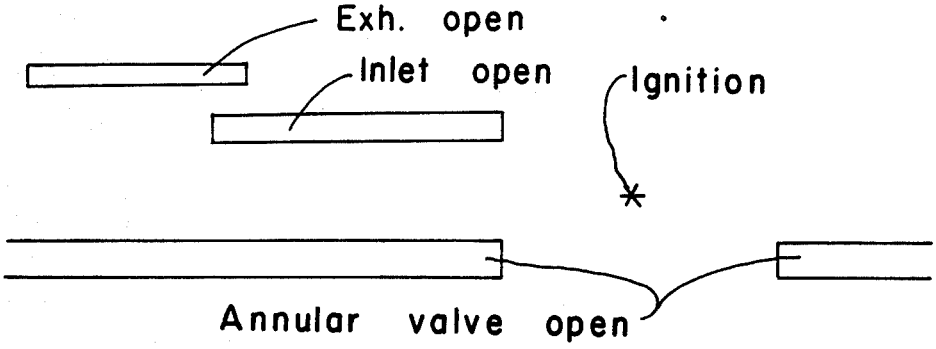
Figure 9:
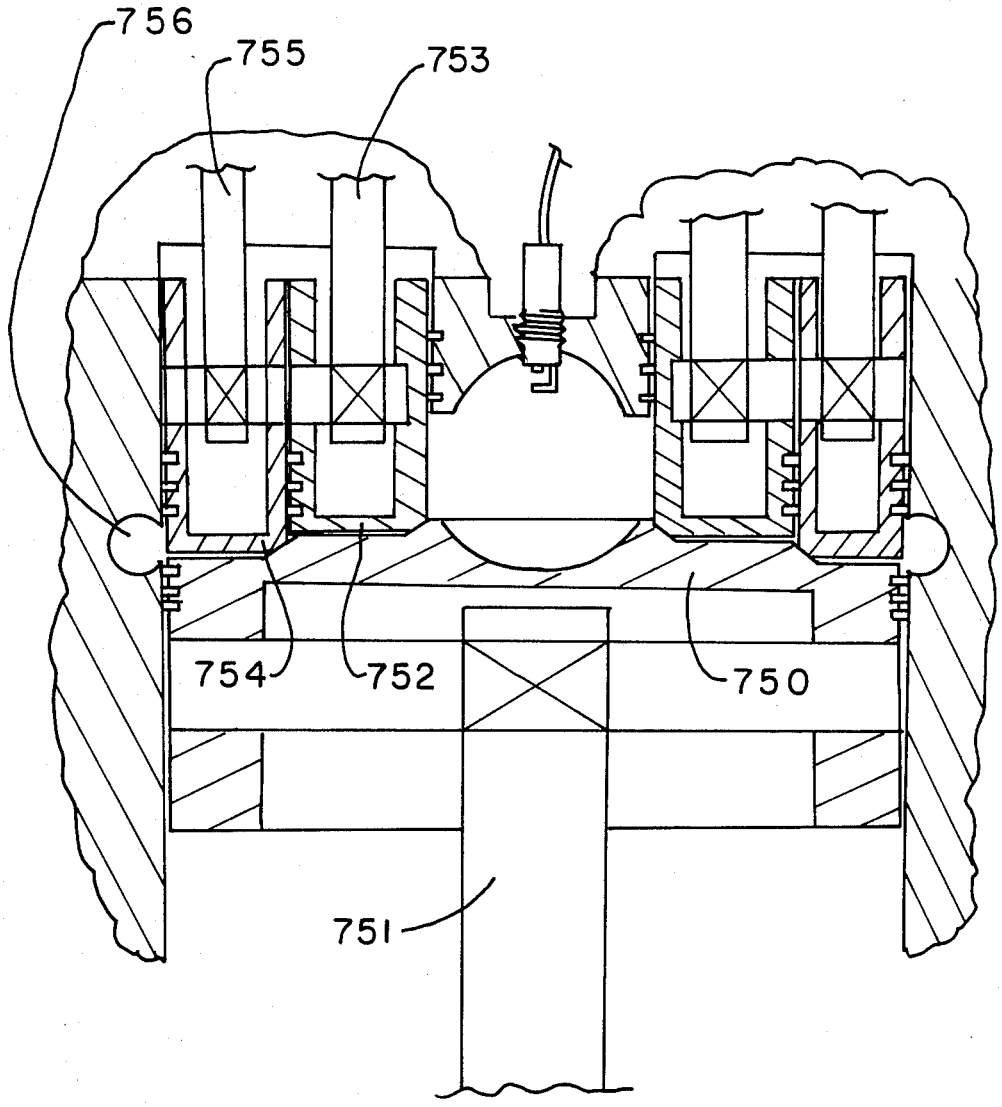
FIG. 9 shows a plurality of auxiliary pistons design employing opposed annular pistons to provide the specified relationships.

FIG. 9 is another approach to this invention where the center reciprocation piston 750 driven by crank 751 with conventional crank drive while annular pistons 752 driven by crank follower 755. Rotary inlet/exhaust valve similar to FIG. 1 is attached to passage 756. The operation is similar to FIG. 7 except that the annular pistons seal the center chamber pressure for the annular surfaces of the center piston as they travel with and against the annular sealing surfaces thereby preventing the combusted charge from exposing itself to these surfaces until after partial expansion at which point the inner annular piston 752 and later the outer annular piston 754 reverse their motion (contact with and following along the piston 750's motion) and permit combusted products against the annular portion of the main piston 750 while the annular piston 752 and later 754 provide additional expansion in a double opposed piston configuration.

The figures presents a reasonable number of approaches but obviously there are many more combinations. A few examples are: (1) CI versions of the SI approaches and vis versa, (2) double opposed arrangements; (3) where fundamental crank motion (without dwells) stroke lengths vary among the pistons, (4) different timing of ignition, fuel injection and annular seal sealing and breaking seal. (5) Use of center piston inlet valve (with or without supercharged inlet mixture) as in FIG. 8 with others such as FIG. 6 (note when supercharged the annular valve of FIG. 6 may be designed to remain sealed except during expansion using the outer annular piston and further said outer annular piston, where cam driven, need not move during intake and compression). Further annular valves (outer annular element) could act as inlet or exhaust valving.

What is claimed is:

1. A four cycle internal combustion engine comprising a cylinder with an auxiliary piston reciprocating in the cylinder and a working piston reciprocating within the auxiliary piston, an auxiliary chamber above said auxiliary piston, a combustion chamber above said working piston, means controlling communication of said auxiliary chamber with said combustion chamber to permit communication during expansion strokes and subsequent exhaust strokes only from when both pistons are moving toward BDC until the auxiliary piston returns to TDC; wherein said controlling means comprises a projection on a top surface of said auxiliary piston adjacent said working piston to prevent communication of the respective chambers with each other when said auxiliary piston is at TDC, and means varying dwell of the auxiliary piston so that the pistons are about ninety degrees out of phase during intake and expansion strokes and substantially in phase during ends of exhaust and compression strokes.

* * * * *